US012429277B2

(12) United States Patent
Burgess et al.

(10) Patent No.: US 12,429,277 B2
(45) Date of Patent: Sep. 30, 2025

(54) REFRIGERATOR STORAGE SYSTEM

(71) Applicant: WHIRLPOOL CORPORATION, Benton Harbor, MI (US)

(72) Inventors: Brent Burgess, Edwardsburg, MI (US); Christopher Carpenter, St. Joseph, MI (US); Christopher Hartnett, St. Joseph, MI (US); Luis Yahir Macias, Stevensville, MI (US); Douglas Pohl, Benton Harbor, MI (US); Steven Schatz, Granger, IN (US); Shekhar Shetty, Cedar Rapids, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 116 days.

(21) Appl. No.: 18/347,358

(22) Filed: Jul. 5, 2023

(65) Prior Publication Data

US 2025/0012506 A1 Jan. 9, 2025

(51) Int. Cl.

| | |
|---|---|
| ***F25D 25/00*** | (2006.01) |
| ***F25D 23/02*** | (2006.01) |
| ***F25D 23/04*** | (2006.01) |
| ***F25D 25/02*** | (2006.01) |

(52) U.S. Cl.

CPC ..... *F25D 25/005* (2013.01); *F25D 23/028* (2013.01); *F25D 23/04* (2013.01); *F25D 25/021* (2013.01); *F25D 25/025* (2013.01)

(58) Field of Classification Search

CPC .. F25D 23/04; F25D 25/025; F25D 2331/806; F25D 25/021; F25D 25/00; F25D 25/005; F25D 23/028; A47B 2210/175; A47B 88/994; A47B 88/70

See application file for complete search history.

(56) References Cited

U.S. PATENT DOCUMENTS 3,473,345 A * 10/1969 Pfeiffer ..... F25D 17/065 62/382
5,346,299 A * 9/1994 Werkmeister ..... F25D 23/04 312/405.1
5,820,239 A * 10/1998 Christenson ..... F25D 25/025 312/334.14
6,565,169 B1 * 5/2003 Moreno-Olguin .... F25D 25/021 312/348.3

(Continued)

FOREIGN PATENT DOCUMENTS

BR 102013027044 A2 8/2015
CN 202195645 U * 4/2012 ..... F25D 25/00

(Continued)

OTHER PUBLICATIONS

CN105466133A translation (Year: 2016).*
CN202195645 translation (Year: 2012).*
DE102009028418 translation (Year: 2011).*

*Primary Examiner* — Hiwot E Tefera
(74) *Attorney, Agent, or Firm* — Brooks Kushman P.C.

(57) ABSTRACT

A refrigerator bin system includes a receptacle, at least one rail, and a secondary container. The receptacle has a top side defining a plurality of orifices of varying sizes configured to receive primary containers of varying sizes. The at least one rail is disposed below receptacle. The secondary container is configured to engage the at least one rail for securing and removing the secondary container onto and from the receptacle.

17 Claims, 6 Drawing Sheets

(56) References Cited

U.S. PATENT DOCUMENTS

| | | | | |
|---|---|---|---|---|
| 6,793,096 | B1 | 9/2004 | Seok | |
| 9,353,989 | B2 | 5/2016 | Furr et al. | |
| 11,268,750 | B1 * | 3/2022 | Hanson | F25D 23/028 |
| 2006/0250063 | A1 * | 11/2006 | Czach | A47B 88/60 312/405.1 |
| 2013/0119846 | A1 * | 5/2013 | Seo | F25D 23/04 312/405 |
| 2013/0221824 | A1 * | 8/2013 | Jeon | A47B 88/994 312/348.3 |
| 2016/0153704 | A1 * | 6/2016 | Burke | A47B 88/70 312/404 |
| 2017/0167778 | A1 * | 6/2017 | Lee | A47B 88/487 |
| 2017/0343274 | A1 * | 11/2017 | Lee | F25D 25/005 |
| 2023/0024634 | A1 * | 1/2023 | Camacho | F25D 25/025 |
| 2023/0095672 | A1 * | 3/2023 | Park | F25D 23/04 312/404 |
| 2023/0204282 | A1 * | 6/2023 | Chang | F25D 25/022 312/402 |
| 2023/0251009 | A1 * | 8/2023 | Jeong | F25C 5/182 62/344 |
| 2023/0258394 | A1 * | 8/2023 | Özer | F25D 25/024 62/382 |

FOREIGN PATENT DOCUMENTS

| | | | | | |
|---|---|---|---|---|---|
| CN | 102506555 | B | | 1/2014 | |
| CN | 105466133 | A | * | 4/2016 | |
| CN | 108131890 | A | * | 6/2018 | F25D 25/027 |
| CN | 218349042 | U | * | 1/2023 | |
| DE | 102009028418 | A1 | * | 2/2011 | F25D 25/025 |
| DE | 102016006219 | A1 | | 9/2017 | |
| DE | 102020102879 | A1 | | 5/2021 | |
| EP | 2944899 | A1 | | 11/2015 | |
| WO | 2013000976 | A2 | | 1/2013 | |
| WO | WO-2013000979 | A2 | * | 1/2013 | F25D 23/04 |
| WO | 2020207776 | A1 | | 10/2020 | |
| WO | 2023048362 | A1 | | 3/2023 | |

* cited by examiner

REFRIGERATOR STORAGE SYSTEM

TECHNICAL FIELD

The present disclosure relates to an appliance such as a refrigerator.

BACKGROUND

In order to keep food fresh, a low temperature must be maintained within a refrigerator to reduce the reproduction rate of harmful bacteria. Refrigerators circulate refrigerant and change the refrigerant from a liquid state to a gas state by an evaporation process in order to cool the air within the refrigerator. During the evaporation process, heat is transferred to the refrigerant. After evaporating, a compressor increases the pressure, and in turn, the temperature of the refrigerant. The gas refrigerant is then condensed into a liquid and the excess heat is rejected to the ambient surroundings. The process then repeats.

SUMMARY

A refrigerator includes a door, a bin, an adapter plate, and a secondary container. The door has an interior surface. The bin is disposed along the interior surface of the door. The bin has a receptacle disposed along a top side of the bin. The bin also includes opposing rails disposed below the receptacle along a bottom side of the of the bin. A space is defined between the opposing rails. The adapter plate is secured to the top side of the bin. The adapter plate defines a plurality of orifices configured to receive primary containers. The secondary container defines grooves on opposing sides of the secondary container. The secondary container is configured to engage the opposing rails within the grooves for inserting and removing the secondary container into and from the space.

A refrigerator door bin system includes a receptacle, rails, an adapter, and a container. The rails extend downward from the receptacle. The rails define a space below the receptacle. The adapter is secured to a top side of the receptacle. The adapter defines a plurality of container-receiving openings. The container is configured to engage the rails for inserting and removing the container into and from the space.

A refrigerator bin system includes a receptacle, at least one rail, and a secondary container. The receptacle has a top side defining a plurality of orifices of varying sizes configured to receive primary containers of varying sizes. The at least one rail is disposed below receptacle. The secondary container is configured to engage the at least one rail for securing and removing the secondary container onto and from the receptacle.

DETAILED DESCRIPTION

Embodiments of the present disclosure are described herein. It is to be understood, however, that the disclosed embodiments are merely examples and other embodiments may take various and alternative forms. The figures are not necessarily to scale; some features could be exaggerated or minimized to show details of particular components. Therefore, specific structural and functional details disclosed herein are not to be interpreted as limiting, but merely as a representative basis for teaching one skilled in the art to variously employ the embodiments. As those of ordinary skill in the art will understand, various features illustrated and described with reference to any one of the figures may be combined with features illustrated in one or more other figures to produce embodiments that are not explicitly illustrated or described. The combinations of features illustrated provide representative embodiments for typical applications. Various combinations and modifications of the features consistent with the teachings of this disclosure, however, could be desired for particular applications or implementations.

Figure 1:
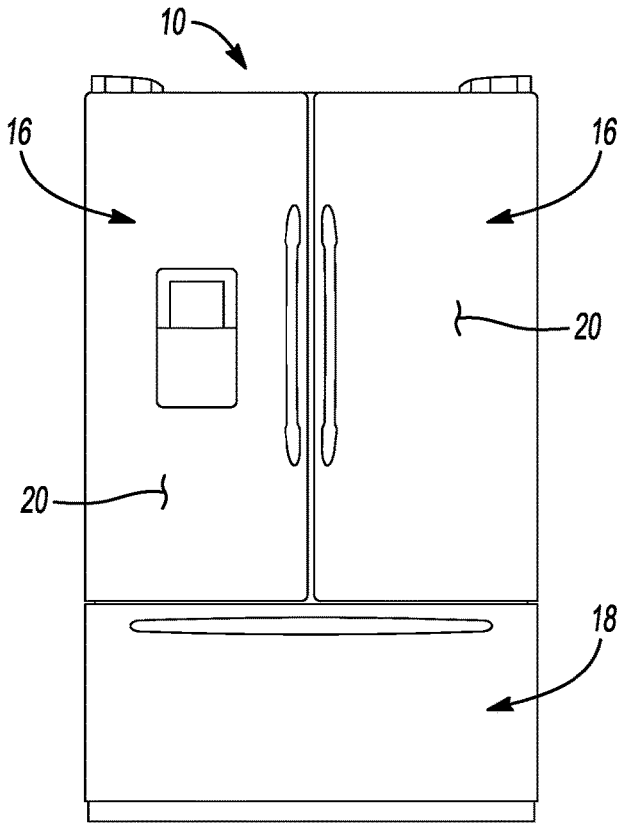
FIG. 1 is an elevated front view of a French-Door Bottom Mount type refrigerator appliance.
Figure 2:
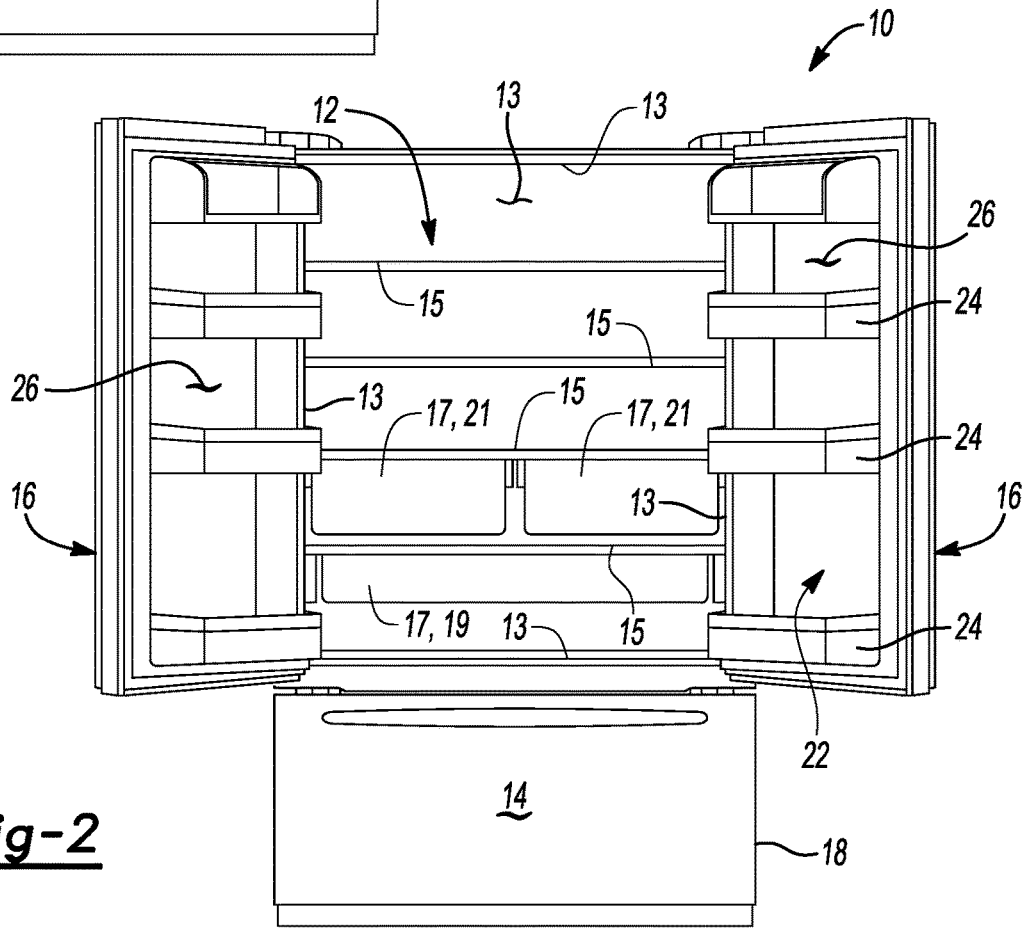
FIG. 2 is an elevated front view of a French-Door Bottom Mount type refrigerator with the refrigerator compartment doors open.
Figure 3:
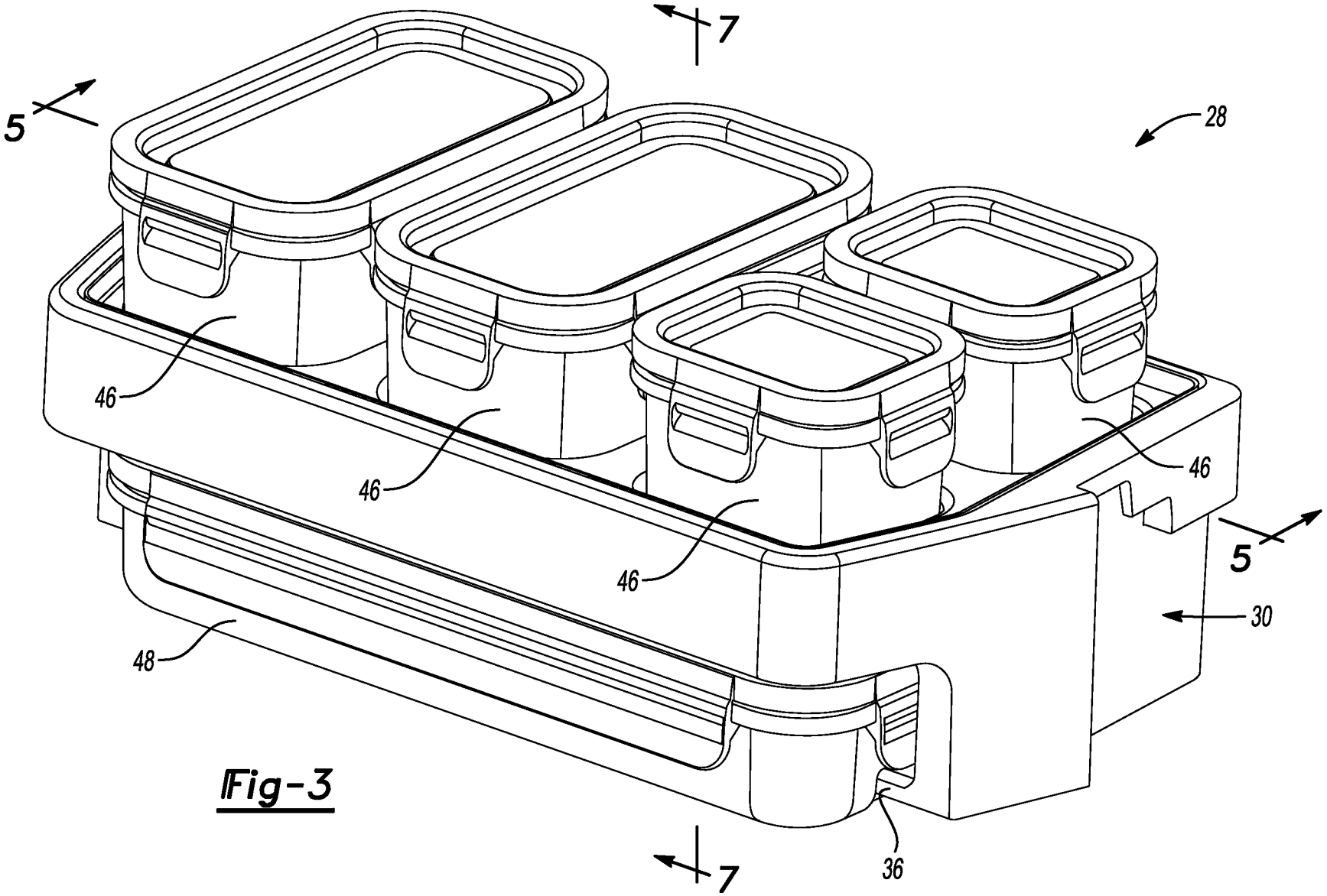
FIG. 3 is an isometric view of a bin system for the refrigerator.
Figure 4:
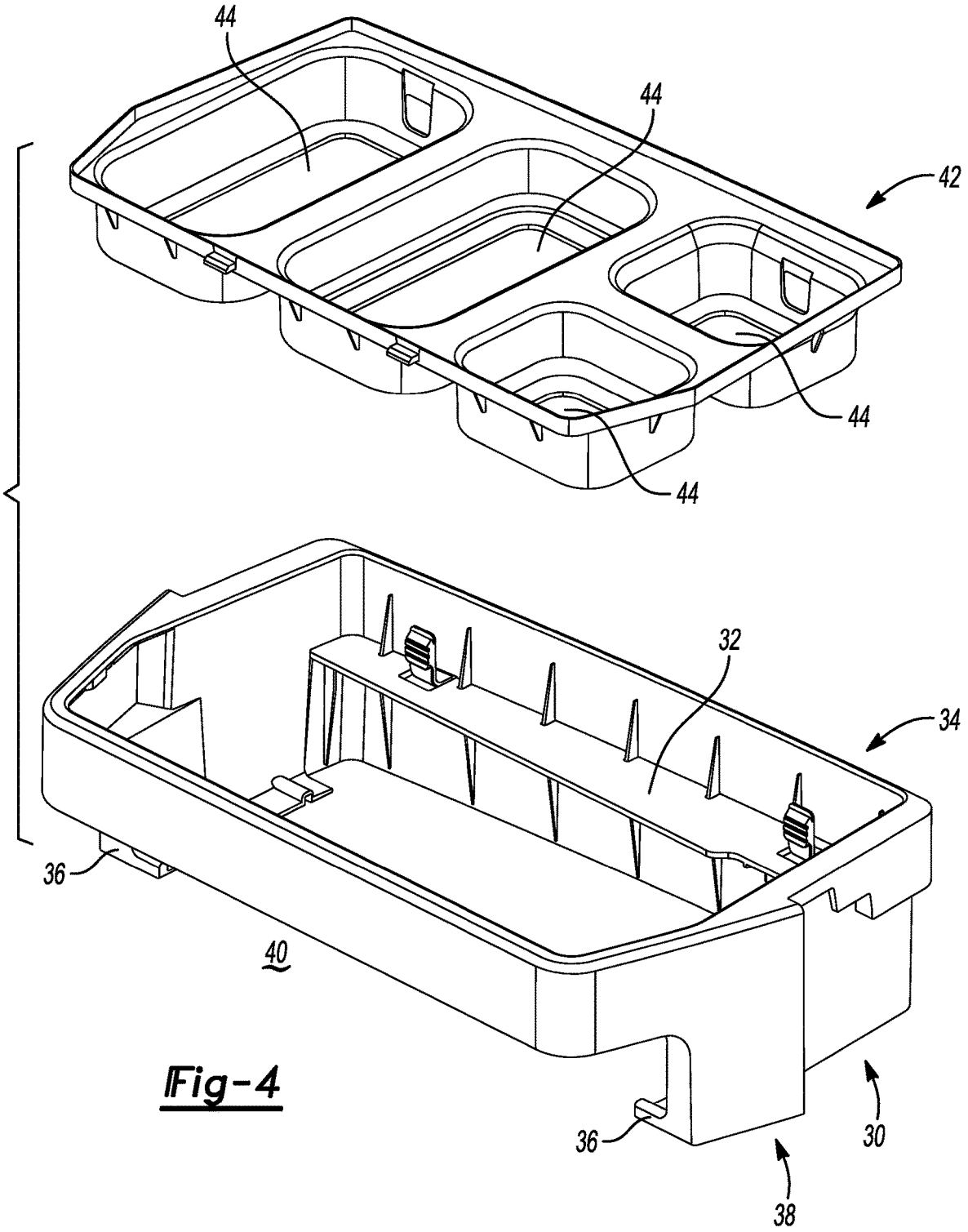
FIG. 4 is an exploded view of a portion of the bin system.
Figure 5:
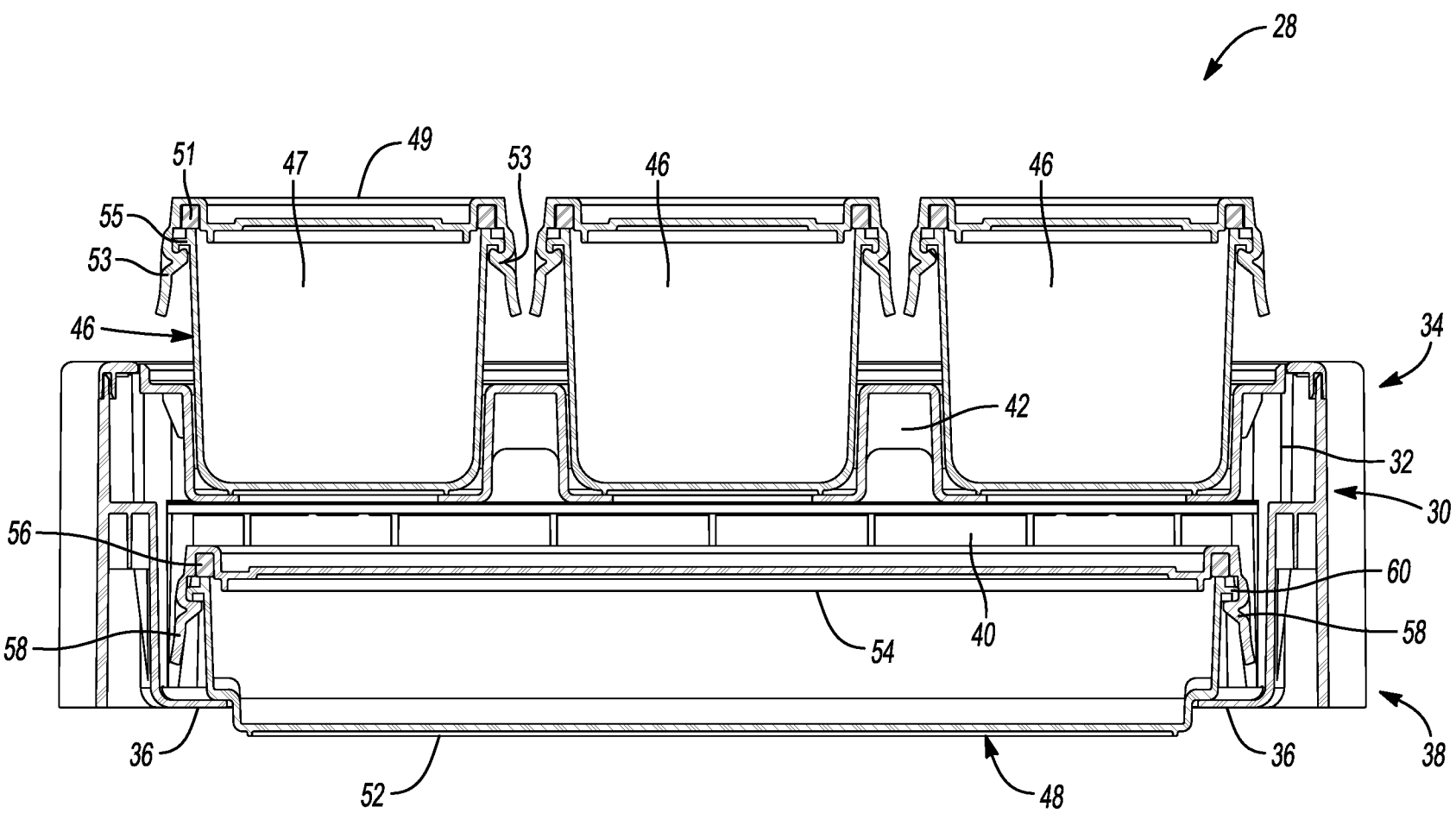
FIG. 5 is a cross-sectional view of the bin system taken along line 5-5 in FIG. 3.
Figure 6:
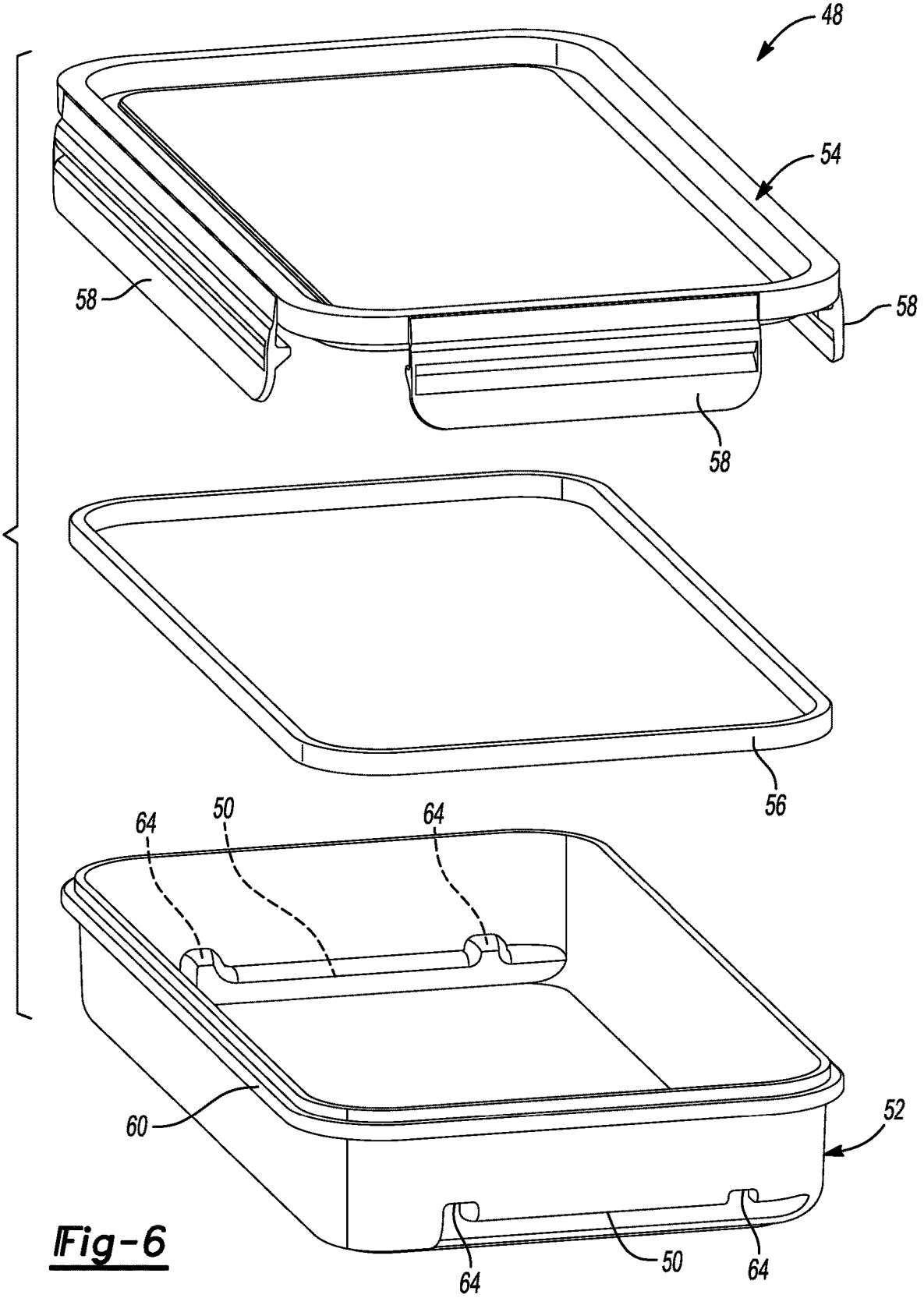
FIG. 6 is an exploded view of a container of the bin system.
Figure 7:
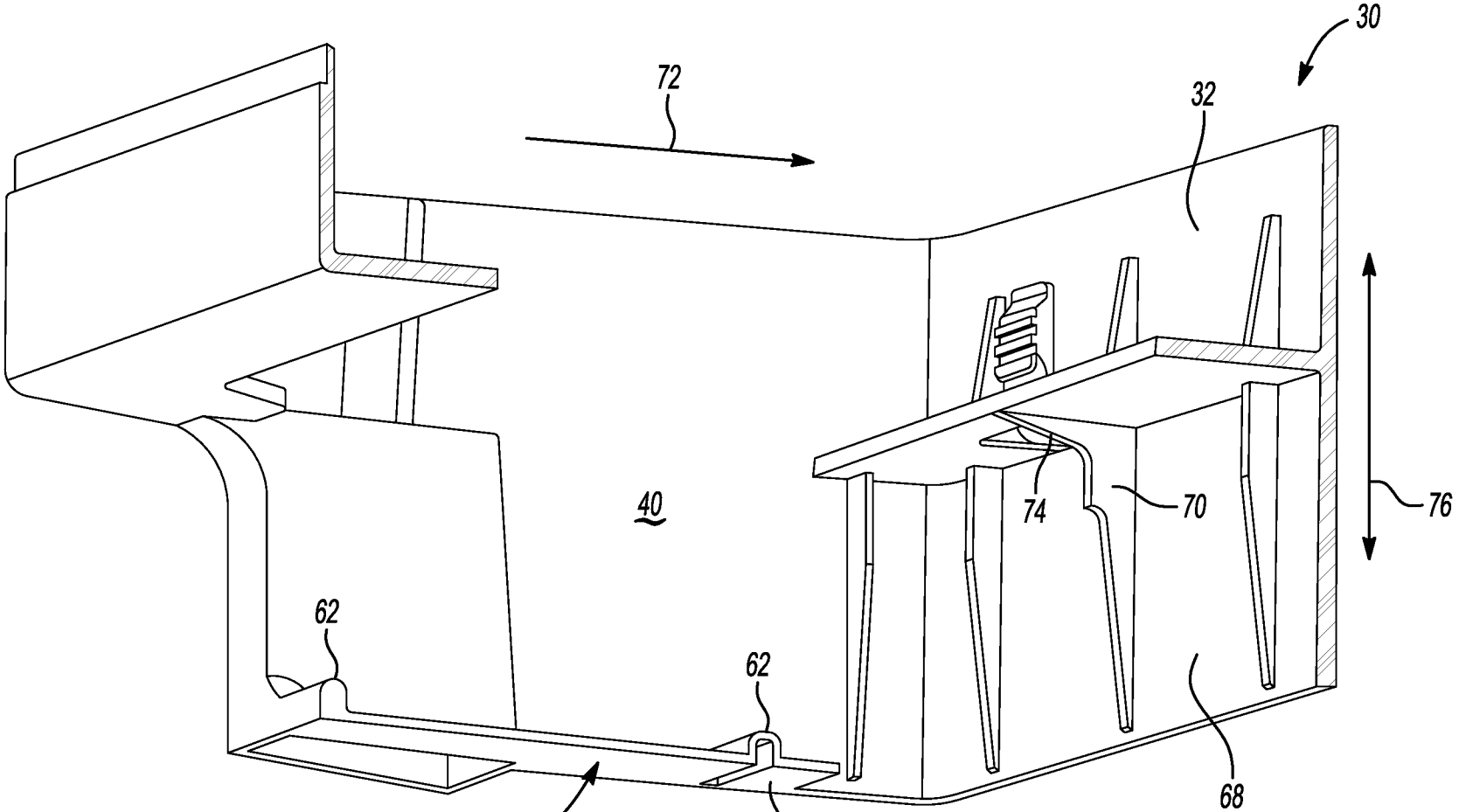
FIG. 7 is a cross-sectional view of a portion of the bin system taken along line 7-7 in FIG. 3.

Referring to FIGS. 1 and 2, generally a refrigerator 10 of the French-Door Bottom Mount type is illustrated. However, it should be understood that this disclosure could apply to any type of refrigerator, such as a side-by-side, two-door bottom mount, or a top-mount type. As shown in FIGS. 1 and 2, the refrigerator 10 may have a first internal storage chamber, internal cavity, or fresh food compartment 12 configured to refrigerate and not freeze consumables within the fresh food compartment 12, and a second internal storage chamber, internal cavity, or a freezer compartment 14 configured to freeze consumables within the freezer compartment 14 during normal use. The refrigerator 10 includes panels or walls 13 that form a housing and define the fresh food compartment 12 and the freezer compartment 14. The walls 13 may more specifically form an inner or internal liner of the refrigerator 10. The walls 13 may include a rear or back wall, a top wall, a bottom wall, and two side walls. The walls 13 may also include additional internal walls, such as a divider wall between the fresh food compartment 12 and freezer compartment 14.

One or more shelves 15 may be secured to the walls 13 within the fresh food compartment 12. One or more drawers 17 may be slidably secured to the shelves 15 or the walls within the fresh food compartment 12. More specifically, the drawers 17 may be slidably secured to the shelves 15 or the walls within the fresh food compartment 12 via tracks or rails. One or more of the drawers 17 may be either a pantry drawer 19 or a crisper drawer 21. Crisper drawer 21 may more specifically be drawers defining a storage space that is kept at a desired humidity that may be different from the remainder of the fresh food compartment 12, but that is optimal for maintaining freshness of fruits and vegetables.

The refrigerator 10 may have one or more doors 16, 18 that provide selective access to the interior volume of the refrigerator 10 where consumables may be stored. As shown, the fresh food compartment doors are designated 16, and the freezer door is designated 18. It may also be shown that the fresh food compartment 12 may only have one door 16. The doors 16 may be rotatably secured to the walls 13 by one or more hinges.

It is generally known that the freezer compartment 14 is typically kept at a temperature below the freezing point of water, and the fresh food compartment 12 is typically kept at a temperature above the freezing point of water and generally below a temperature of from about 35° F. to about 50° F., more typically below about 38° F.

The doors 16 may each include an exterior panel 20 and an interior panel 22 that is disposed on an internal side of the respective exterior panel 20 of each door 16. The interior panels 22 may be configured to face the fresh food compartment 12 when the doors 16 are in closed positions (See FIG. 1). The interior panel 22 may more specifically be a door liner. An insulating material, such as an insulating foam, may be disposed between the exterior panel 20 and interior panel 22 of each door 16 in order to reduce the heat transfer from the ambient surroundings and increase the efficiency of the refrigerator.

The refrigerator 10 may also have a water inlet that is fastened to and in fluid communication with a household water supply of potable water. Typically, the household water supply connects to a municipal water source or a well. The water inlet may be fluidly engaged with one or more of a water filter, a water reservoir, and a refrigerator water supply line. The refrigerator water supply line may include one or more nozzles and one or more valves. The refrigerator water supply line may supply water to one or more water outlets; typically one outlet for water is in the dispensing area and another to an ice tray. The refrigerator 10 may also have a control board or controller that sends electrical signals to the one or more valves when prompted by a user that water is desired or if an ice making cycle is required.

Such a controller may be part of a larger control system and may be controlled by various other controllers throughout the refrigerator 10, and one or more other controllers can collectively be referred to as a "controller" that controls various functions of the refrigerator 10 in response to inputs or signals to control functions of the refrigerator 10. The controller may include a microprocessor or central processing unit (CPU) in communication with various types of computer readable storage devices or media. Computer readable storage devices or media may include volatile and nonvolatile storage in read-only memory (ROM), random-access memory (RAM), and keep-alive memory (KAM), for example. KAM is a persistent or non-volatile memory that may be used to store various operating variables while the CPU is powered down. Computer-readable storage devices or media may be implemented using any of a number of known memory devices such as PROMs (programmable read-only memory), EPROMs (electrically PROM), EEPROMs (electrically erasable PROM), flash memory, or any other electric, magnetic, optical, or combination memory devices capable of storing data, some of which represent executable instructions, used by the controller in controlling the refrigerator 10.

Control logic or functions performed by the controller may be represented by flow charts or similar diagrams in one or more figures. These figures provide representative control strategies and/or logic that may be implemented using one or more processing strategies such as event-driven, interrupt-driven, multi-tasking, multi-threading, and the like. As such, various steps or functions illustrated may be performed in the sequence illustrated, in parallel, or in some cases omitted. Although not always explicitly illustrated, one of ordinary skill in the art will recognize that one or more of the illustrated steps or functions may be repeatedly performed depending upon the particular processing strategy being used. Similarly, the order of processing is not necessarily required to achieve the features and advantages described herein, but is provided for case of illustration and description. The control logic may be implemented primarily in software executed by a microprocessor-based controller. Of course, the control logic may be implemented in software, hardware, or a combination of software and hardware in one or more controllers depending upon the particular application. When implemented in software, the control logic may be provided in one or more computer-readable storage devices or media having stored data representing code or instructions executed by a computer to control the refrigerator 10 or its subsystems. The computer-readable storage devices or media may include one or more of a number of known physical devices which utilize electric, magnetic, and/or optical storage to keep executable instructions and associated calibration information, operating variables, and the like.

The doors 16 may also include storage bins 24 that are able to hold food items or containers. The storage bins 24 may be secured to interior surfaces 26 or the interior panels 22 of each door 16. Alternatively, the storage bins 24 may integrally formed within or defined by the interior panels 22 of each door 16. In yet another alternative, a portion of the storage bins 24 may be secured to the interior panels 22 of each door 16, while another portion of the storage bins 24 may be integrally formed within or defined by the interior panels 22 of each door 16. The storage bins 24 may include shelves (e.g., a lower surface upon, which a food item or container may rest upon) that extend from back and/or side surfaces of the interior panels 22 of each door 16.

Referring to FIGS. 3-7, a bin system 28 for the refrigerator 10 is illustrated. The bin system 28 may be referred to as the refrigerator bin system. The bin system 28 may be disposed anywhere within the refrigerator 10 (e.g., within the fresh food compartment 12 or the freezer compartment 14). The bin system 28 may be secured to one of the panels or walls 13 within the fresh food compartment 12 or the freezer compartment 14. The bins system 28 may be secured to one of the doors 16 (e.g., the bin system 28 may be secured to the interior surface 26 or the interior panel 22 of one of the doors 16). For example, one or more of the bins 24 illustrated in FIG. 3 may be replaced by the bin system 28. If the bin system 28 is secured to one of the doors 26, the bin system 28 may be referred to as the refrigerator door bin system.

The bin system 28 may be disposed along or secured to the interior surface 26 or the interior panel 22 of one of the doors 16. Alternatively, the bin system 28 may disposed along or secured to one of the panels or walls 13 within the fresh food compartment 12 or the freezer compartment 14. The bin system 28 includes a bin 30. The bin 30 has a receptacle 32 disposed along a top side 34 of the bin 30. The bin 30 also includes at least one rail (hereinafter referred to as rails 36) that are disposed below the receptacle 32 along a bottom side 38 of the of the bin 30. The rails 36 extending downward from receptacle 32 and define a space 40 below the receptacle 32. The rails 32 may include first and second spaced-apart opposing rails and the space 40 may be at least partially defined between the first and second opposing rails.

An insert or adapter plate 42 is secured to the top side 34 of the bin 30. More specifically, the adapter plate 42 may be secured to the top side of the receptacle 32. The adapter plate 42 defines a plurality of orifices 44 configured to receive primary containers 46. The orifices 44 may be referred to as container-receiving openings. The plurality of orifices 44 may vary in size, the primary containers 46 may vary in size, and the orifices 44 may be configured to receive primary containers 46 having corresponding sizes. Alternatively, the bin 30, or more specifically the receptacle 32, may define the plurality of orifices 44 as opposed to a separate adapter plate 42.

The depth at which the primary containers 46 extend downward into the adapter plate 42 is designed to be equal to or within a plus or minus 15% variance of the height of the center of mass of the primary containers 46. When the center of mass of each primary container 46 is below the top of the adapter plate 42, or very close to the top of the adapter plate 42 (e.g., with the plus or minus 15% variance), the primary containers 46 have an unfavorable rotational moment about the adapter plate 42, maintaining the position of the primary containers 46 on the bin system 28 as the refrigerator doors 16 open and close. Furthermore, when the primary containers 46 are partially filled with food (e.g., below the top of the container), the resultant center of masses of the primary containers 46 is below the center of masses of the empty primary containers 46 resulting in an increased favorable condition for the primary containers 46 to remain in place and not rotate out of the adapter plate 42 as the refrigerator doors 16 open and close.

A secondary container 48 is configured to engage the rails 36 for securing the secondary container 48 onto the bin 30, or more specifically onto the receptacle 32, and for removing the secondary container 48 from the bin 30, or more specifically from the receptacle 32. More specifically, the secondary container 48 is configured to engage the rails 36 for inserting the secondary container 48 into the space 40 and for removing the secondary container 48 from the space 40. The secondary container 48 defines grooves 50 on opposing sides of the secondary container 48. The secondary container 48 is configured to engage the rails 36 within the grooves 50 for inserting the secondary container 48 into the space 40 and for removing the secondary container 48 from the space 40.

The secondary container 48 may include a container portion 52, a lid 54, and a seal 56. The seal 56 may be disposed between the lid 54 and the container portion 52. The lid 54 may include clips, clamps, or snaps 58 that engage a ridge 60 protruding from an outer periphery of the container portion 52 to secure the lid 54 to the container portion 52. Engagement of the snaps 58 and the ridge 60 may result in the lid 54 compressing the seal 56 and forcing the seal 56 into contact with the container portion 52 such that seal 56 prevents the contents within the secondary container 48 from spilling out of the container portion 52 when the lid 54 is secured to the container portion 52.

Each primary container 46 may include all of the same subcomponents as the secondary container 48 (e.g., each primary container 46 may include a container portion 47, a lid 49, a seal 51, snaps 53, and a ridge 55) that may function in the same manner as subcomponents the secondary container 48 (e.g., engagement of the snaps 53 and the ridge 55 may result in the lid 49 compressing the seal 51 and forcing the seal 51 into contact with the container portion 47 such that seal 51 prevents the contents within each primary container 46 from spilling out of the container portion 47 when the lid 49 is secured to the container portion 47).

The rails 36 may include upward at least one upward extending protrusion (hereinafter upward extending protrusions 62). The secondary container 48 defines at least one notch (hereinafter notches 64) extending upward from the grooves 50. The upward extending protrusions 62 are configured to engage the secondary container 48 within the notches 64 to secure the position of the secondary container 48 on the bin 30, or more specifically on the receptacle 32. Also, the upward extending protrusions 62 are configured to engage the secondary container 48 within the notches 64 to secure the position of the secondary container 48 within the space 40.

Rearward ends 66 of the rails 36 are sloped downward. The secondary container 48 may be configured to engage the rearward ends 66 of the rails 36 such that the secondary container 48 is biased onto the bin 30, toward a back end 68 of the bin 30, and into the space 40. More specifically, the secondary container 48 may be configured to engage the rearward ends 66 of the rails 36 such that the secondary container 48 is biased onto the receptacle 32, toward a back end of the receptacle 32, and into the space 40.

The bin 30 may further comprise a stop 70, or multiple stops 70, disposed along the back end 68 of the bin 30 within the space 40 The stop 70 is configured to engage the secondary container 48 to limit travel of the secondary container 48 relative to the bin 30 and into the space 40 along direction 72. The stop 70 may more specifically extend downward from the receptacle 32 and into the space 40, and may be configured to engage the secondary container 48 to limit travel of the secondary container 48 relative to the receptacle 32 and into the space 40 along direction 72.

The bin 30 may further comprise a protrusion 74 configured to engage a top of the secondary container 48 to restrict vertical movement of the secondary container 48 (e.g., movement along vertical axis 76) relative to the bin 30 and within the space 40. The protrusion 74 may more specifically extend downward from the receptacle 32 and into the space 40, and may be configured to engage top of the secondary container 48 to restrict vertical movement of the secondary container 48 (e.g., movement along vertical axis 76) relative to the receptacle 32 and within the space 40. The protrusion may include a ramped section that engages the secondary container 48 to wedge or lodge the secondary container 48 onto the bin 30. The protrusion 74 may be integral with the stop 70.

Engagement between the upward extending protrusions 62 and the notches 64, biasing the secondary container toward the back end 68 of the bin 30 via the sloped rearward ends 66 of the rails 36, and the protrusion 74 engaging the top of the secondary container 48 to restrict vertical movement of the secondary container 48 operates to lock the secondary container 48 to the bin 30, or more specifically to the receptacle 32. The secondary container 48 essentially hangs from the rails 36. Therefore, the various engagements that operate to lock the secondary container 48 to the bin 30 prevent the secondary container from dislodging or moving as the refrigerator doors 16 open and close, or in the event the refrigerator doors 16 are slammed.

It should be understood that the designations of first, second, third, fourth, etc. for any component, state, or condition described herein may be rearranged in the claims so that they are in chronological order with respect to the claims. Furthermore, it should be understood that any component, state, or condition described herein that does not have a numerical designation may be given a designation of first, second, third, fourth, etc. in the claims if one or more of the specific component, state, or condition are claimed.

The words used in the specification are words of description rather than limitation, and it is understood that various changes may be made without departing from the spirit and scope of the disclosure. As previously described, the features of various embodiments may be combined to form further embodiments that may not be explicitly described or illustrated. While various embodiments could have been described as providing advantages or being preferred over other embodiments or prior art implementations with respect to one or more desired characteristics, those of ordinary skill in the art recognize that one or more features or characteristics may be compromised to achieve desired overall system attributes, which depend on the specific application and implementation. As such, embodiments described as less desirable than other embodiments or prior art implementations with respect to one or more characteristics are not outside the scope of the disclosure and may be desirable for particular applications.

What is claimed is:

1. A refrigerator comprising:

a door having an interior surface;

a bin disposed along the interior surface of the door, the bin having (i) a receptacle disposed along a top side of the bin, (ii) opposing rails disposed below the receptacle along a bottom side of the of the bin, wherein a space is defined between the opposing rails, and (iii) a protrusion having a ramped region that extends downward, into the space and toward a back end of the bin;

primary containers;

a secondary container defining grooves on opposing sides of the secondary container; and an adapter plate (i) secured to the top side of the bin and (ii) defining a plurality of orifices configured to receive the primary containers, wherein (a) the rails are configured to interact with the secondary container, (b) the secondary container is configured to engage the opposing rails within the grooves for inserting and removing the secondary container into and from the space, and (c) the ramped region of the protrusion is configured to engage a top of the secondary container along a rear of the secondary container to wedge the secondary container onto the bin, force the rear of the secondary container downward, and restrict vertical movement of the secondary container within the space, and wherein (i) rearward ends of the opposing rails are sloped downward and (ii) the secondary container is configured to engage the rearward ends of the opposing rails such that the secondary container is biased toward the back end of the bin and into the space.

2. The refrigerator of claim 1, wherein (i) the opposing rails include forward and rearward upward extending protrusions, (ii) the secondary container defines forward and rearward notches extending upward from the grooves along forward and rearward regions of the secondary container, and (iii) the forward and rearward upward extending protrusions are configured to engage the secondary container within the forward and rearward notches to secure the position of the secondary container within the space.

3. The refrigerator of claim 1, wherein (i) the bin further comprises a stop disposed along the back end of the bin within the space and space, (ii) the stop is configured to engage the secondary container to limit travel of the secondary container into the space, and (iii) the ramped region of the protrusion terminates at the stop.

4. The refrigerator of claim 1, wherein (i) the plurality of orifices includes varying-sized orifices, (ii) the primary containers include varying-sized containers, and (iii) the varying-sized orifices are configured receive corresponding varying-sized containers.

5. The refrigerator of claim 1, wherein the primary and secondary containers each include removable lids, and wherein the removable lids include snaps for securing the removable lids to the primary and secondary containers.

6. A refrigerator door bin system comprising:

a receptacle;

rails extending downward from the receptacle and defining a space below the receptacle;

a protrusion having a ramped region that extends downward from the receptacle, into the space, and toward a back end of receptacle;

an adapter (i) secured to a top side of the receptacle and (ii) defining a plurality of container-receiving openings; and a container configured to engage the rails for inserting and removing the container into and from the space, wherein the ramped region of the protrusion is configured to engage a top of the container along a rear of the container to wedge the container onto the receptacle, force the rear of the container downward, and restrict vertical movement of the container within the space, and wherein (i) rearward ends of the rails are sloped downward and (ii) the container is configured to engage the rearward ends of the rails such that the container is biased into the space.

7. The refrigerator door bin system of claim 6, wherein (i) the rails include forward and rearward upward extending protrusions, (ii) the container defines forward and rearward notches along forward and rearward regions of the container, and (iii) the forward and rearward upward extending protrusions are configured to engage the container within the forward and rearward notches to secure the position of the container within the space.

8. The refrigerator door bin system of claim 6 further comprising a stop extending downward from the receptacle and into the space, wherein the stop is configured to engage the container to limit travel of the container into the space, and wherein the ramped region of the protrusion terminates at the stop.

9. The refrigerator door bin system of claim 6, wherein the plurality of container-receiving openings includes varying-sized openings.

10. The refrigerator door bin system of claim 6, wherein (i) the rails include first and second spaced-apart rails and (ii) the first and second spaced-apart rails at least partially define the space therebetween.

11. The refrigerator door bin system of claim 6, wherein the container includes a removable lid, and wherein the removable lid includes snaps for securing the removable lid to the container.

12. A refrigerator bin system comprising:

a receptacle having a top side defining a plurality of orifices of varying sizes configured to receive primary containers of varying sizes;

a protrusion having a ramped region that extends downward from the receptacle and toward a back end of receptacle;

a secondary container; and at least one rail disposed below receptacle, wherein the at least one rail is configured to interact with the secondary container such that the secondary container engages the at least one rail for securing and removing the secondary container onto and from the receptacle, wherein the protrusion configured to engage a top of the secondary container along a rear of the secondary container to wedge the secondary container onto the receptacle, force the rear of the secondary container downward, and restrict vertical movement of the secondary container relative to the receptacle, wherein (i) rearward ends of each rail of the at least one rail are sloped downward and (ii) the secondary container is configured to engage the rearward ends of each rail of the at least one rail such that the secondary container is biased onto the receptacle.

13. The refrigerator bin system of claim 12, wherein at least one rail includes at least one forward upward extending protrusion and at least one rearward upward extending protrusion, (ii) the secondary container defines at least one forward notch and at least one rearward notch, and (iii) the at least one forward upward extending protrusion is configured to engage the secondary container within the at least one forward notch and the at least one rearward upward extending protrusion is configured to engage the secondary container within the at least one rearward notch to secure the position of the secondary container on the receptacle.

14. The refrigerator bin system of claim 12 further comprising a stop extending downward from the receptacle, wherein the stop is configured to engage the secondary container to limit travel of the secondary container relative to the receptacle, and wherein the ramped region of the protrusion terminates at the stop.

15. The refrigerator bin system of claim 12, wherein the at least one rail includes first and second rails.

16. The refrigerator bin system of claim 15, wherein the first and second rails define a space therebetween that is configured to receive the secondary container.

17. The refrigerator bin system of claim 12, wherein secondary container includes a removable lid, and wherein the removable lid includes snaps for securing the removable lid to the secondary container.

* * * * *